United States Patent [19]

Wehrmann

[11] Patent Number: 4,524,919

[45] Date of Patent: Jun. 25, 1985

[54] MULTIPLE BOLT TURNING MACHINE

[75] Inventor: Claus Wehrmann, Extertal, Fed. Rep. of Germany

[73] Assignee: Lenze GmbH & Co. KG Aerzen, Aerzen, Fed. Rep. of Germany

[21] Appl. No.: 466,985

[22] Filed: Feb. 15, 1983

[30] Foreign Application Priority Data

Feb. 18, 1982 [DE] Fed. Rep. of Germany ..... 3205779

[51] Int. Cl.[3] ..... B65H 19/20

[52] U.S. Cl. ..... 242/67.1 R; 242/55

[58] Field of Search ..... 242/65, 64, 67.1 R, 242/67.5, 56.3, 56 A, 66

[56] References Cited

U.S. PATENT DOCUMENTS

| | | | |
|---|---|---|---|
| 3,472,462 | 10/1969 | Young | 242/64 X |
| 3,963,187 | 6/1976 | Ohi | 242/56.2 X |
| 4,150,797 | 4/1979 | Kataoka | 242/67.1 R |
| 4,153,215 | 5/1979 | Schulze | 242/56 A |
| 4,463,586 | 8/1984 | Griffin | 242/67.1 R X |

FOREIGN PATENT DOCUMENTS

| | | |
|---|---|---|
| 7728223 | 7/1977 | Fed. Rep. of Germany . |
| 8124903 | 1/1982 | Fed. Rep. of Germany . |

*Primary Examiner*—Stephen Marcus
*Assistant Examiner*—Leo J. Peters
*Attorney, Agent, or Firm*—Pollock, Vande Sande and Priddy

[57] ABSTRACT

A multiple bolt turning machine comprises a winding star which is adapted to rotate a bolt being wound with a web of material from a bolt winding position to a bolt removal position. A feed roll engages the incoming web of material at the bolt winding position, and as the winding star rotates to move the bolt from the winding position to the removal position the feed roll is also repositioned to remain in contact with the bolt, and is concurrently moved in a direction transverse to the axes of rotation of the winding star and feed roll to keep the angle of contact between the feed roll and the web of material substantially constant throughout the movement of the bolt between said winding and removal positions.

9 Claims, 4 Drawing Figures

MULTIPLE BOLT TURNING MACHINE

BACKGROUND OF THE INVENTION

The present invention relates to a multiple bolt turning machine of the type comprising a winding star which is adapted to be rotated from one to the next of a plurality of bolt positions, at least one of said positions comprising a bolt winding position and at least one other of said positions comprising a bolt removal position. The machine includes a feed roll which functions to press the width of an incoming web of material against the bolt during the winding process, and servomotors responsive to the tilt position of the winding star are provided to cause the feed roll to follow the bolt as the bolt is shifted by the winding star between the said winding and removal positions.

Arrangements of the general type described above, with which the present invention is concerned, have been suggested heretofore. In one known device of this type (DE-GM 77 28 223) the feed roll is supported on a pair of knee levers and connected to the drive of the winding star by a coupling. As the full bolt is pivoted toward its removal position, the winding star drive shifts the positions of the knee levers thereby to reposition the feed roll, and when the winding star has pivoted the full bolt into its end position the coupling disengages and the pair of knee levers are returned to their starting position by means of a pneumatic cylinder so that the feed roll can then cooperate in the winding of a new empty bolt. In another known arrangement of the general type described earlier (DE-GM 81 24 903) carriers, arranged on the winding star, are shaped to rest against carrier areas on a pair of knee levers, and operate to carry along the feed roll system on the bolt as the winding star turns to move the bolt from its winding position to its removal position.

Both of the known devices described above have the disadvantage that the angle of contact of the incoming web of material against the feed roll changes constantly as the bolt is shifted from its winding to its removal position. This occurs, in both of the prior devices described above, as a result of the forced coupling between the moving winding star and the moving feed roll. The constant change in the angle of contact between the width of the incoming material and the feed roll has been found to cause a number of problems, e.g., it tends to cause a trapping of air in the bolt, and also causes the formation of wrinkles which disturb the feeding of the material onto the bolt. The present invention is intended to obviate these problems, i.e., it constitutes a multiple bolt turning machine of the known type earlier described, which is so constructed, however, that it assures a smooth feeding and a faultless winding of the incoming web of material onto the bolt, even during the period of time that the bolt is being rotated by the winding star from its winding position to its removal position.

SUMMARY OF THE INVENTION

The problems of the prior art, described above, are solved in the present invention by the provision of adjustable motors which are coupled to the feed roll, and which are adapted to be controlled in dependence on the diameter of the bolt in such manner that the angle of contact between the web of material and the feed roll remains essentially constant at all times.

In a preferred embodiment of the invention, the feed roll is mounted in a frame which is adapted to be pivoted about a pivot axis that is spaced from and parallel to the axis of rotation of the feed roll. This pivotal motion is accomplished by first positioning means consisting, e.g., of one or more servomotors that are controlled in dependence on the tilt position of the winding star, and which preferably take the form of pneumatic or hydraulic cylinder-piston devices. The feed roll is also adapted to be adjusted in position relative to the aforementioned pivot axis by second positioning means which comprise a second servomotor, e.g., an electric motor preferably a DC motor, as the frame is pivoted about the said pivot axis by the first servomotor means. This adjustment in position of the feed roll, under the control of the second servomotor and in a direction transverse to the pivot axis of the frame and transverse to the axis of rotation of the winding star, is effected in such manner as to achieve the substantially constant angle of contact between the web of material and the feed roll which avoids the problems of the prior art.

In an actual device constructed in accordance with the present invention, the proper position of the feed roll relative to the bolt is determined by a sensor which is responsive to the diameter of the bolt and by a further sensor which is responsive to the tilt position of the winding star, and the outputs of these sensors are supplied to a function generator or computer through appropriate signal devices. The function generator or computer, in response to said sensor signals, determines the proper position of the feed roll and supplies a corresponding signal to a position control device. The position control device is also supplied with information generated by a position indicator on the feed roll, or on an element connected to the feed roll, which indicates the existing position of the feed roll, and generates an adjustment signal which controls the aforementioned DC electric motor, i.e., the second positioning means. In an alternative embodiment of the invention, however, instead of using an analog type of control, digital controls comprising microprocessors can be used.

The second positioning means, i.e., the aforementioned DC electric motor, is preferably mounted on the frame which supports the feed roll so that the said DC electric motor pivots with said frame. The output shaft of the electric motor rotates a threaded spindle which is in thread engagement with a spindle nut; and the spindle nut in turn is connected to the bearing for the feed roll. As the DC electric motor shaft rotates under the control of the aforementioned adjustment signal, the shaft rotation is converted by the rotating spindle and associated spindle nut into a translational motion of the feed roll in a direction transverse to the axis of rotation of the feed roll.

BRIEF DESCRIPTION OF THE DRAWINGS

The foregoing objects, advantages, construction and operation of the present invention will become more readily apparent from the following description and accompanying drawings wherein.

DESCRIPTION OF THE PREFERRED EMBODIMENTS

Figure 1:
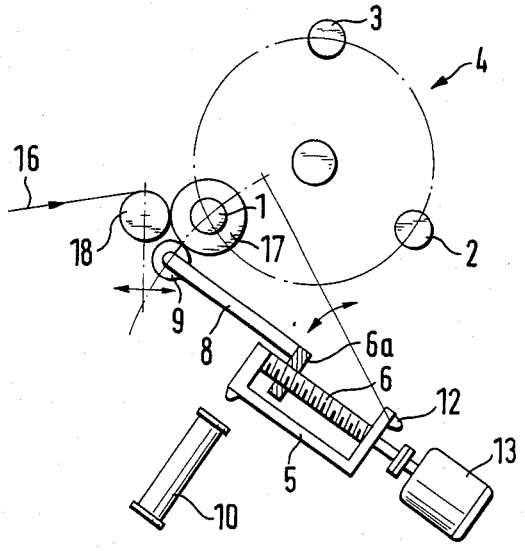
FIG. 1 is a schematic side view of a winding machine constructed in accordance with the present invention, with the feed roll in the winding position.

Referring now to the several figures, like numerals of which refer to like parts throughout, a winding star 4 is arranged to exhibit three winding positions 1, 2 and 3, and is adapted to be rotated by a motor (not shown) which turns the star so as to transfer a bolt being wound from a winding position 1 to a removal position 2. A frame 5 is situated below the winding star 4 for pivotal motion about a shaft 12 which is spaced from and parallel to the axis of rotation of the winding star 4, and spaced from and parallel to the axis of rotation of a feed roller 9. The pivotal frame 5 has a pair of threaded spindles 6, 7 mounted adjacent opposing sides thereof in parallel relation to one another. Spindle 6 is rotated by the shaft of an electric motor 13 which is so mounted as to move pivotally with the pivotal motion of frame 5, and a drive chain 14 extending between spindles 6 and 7 simultaneously effects rotation of spindle 7 in synchronism with the rotation of spindle 6. A pair of spindle nuts 6*a*, 7*a* are in thread engagement with spindles 6, 7 respectively, and these spindle nuts are attached to one end of a frame 8 the other end of which has a pair of bearings in which the opposing ends of the feed roller 9 are mounted.

Pivotal motion of the frame 5 about shaft 12 effects like pivotal motion of frame 8 and of feed roll 9 about the same shaft 12. A pair of pneumatic or hydraulic cylinder-piston devices 10, 11 engage frame 5 on opposing sides thereof and operate to generate pressure for the feed roll onto the bolt. The web of material 16 being wound is fed toward bolt 17 over a roller 18 which is positioned with its axis parallel to the axis of the bolt, and which is adapted to shift in position horizontally away from the axis of bolt 17 as the diameter of the bolt increases. The web of material passes from roller 18 through the nips between rollers 18 and 9 and the bolt 17 as the material is wound onto the bolt at winding position 1. Roller 18 is in close engagement with the exterior surface of bolt 17 to prevent the introduction or trapping of air into the bolt as the material is being wound. Feed roll 9 also engages bolt 17 at a position adjacent to roller 18, and is pressed against the bolt 17 by means of the cylinders 10, 11 at a rate that is constant or controlled by a program.

Shortly before the bolt 17 reaches its final diameter, the turning process of the winding star 4 is initiated. For this purpose, the winding star 4 turns in a counter clockwise direction so as to move the bolt 17 from the winding position shown in FIG. 1 to the removal position shown in solid line 17 in FIG. 2. During this turning process, the feed roller 9 is also caused to move, in a preprogrammed manner, away from the roller 18 while continuing to rest against the bolt 17. This movement of the feed roll 9 shifts the feed roll into positions that are favorable for the guiding of the web of material during the winding star turning process and, more particularly, causes the angle of contact between the web of material and the feed roll to assume an angle of contact $\alpha$ that has been determined to be favorable. As shown in FIG. 2, the "angle of contact" is the angle between a line passing through the axis of rotation of feed roll 9 and the point where the incoming web 16 initially contacts the feed roll, and a line which passes through the axis of rotation of the feed roll 9 and the point where web 16 leaves the feed roll. As the turning process continues, this angle of contact $\alpha$ is maintained without any significant change while the engagement between the feed roll 9 and the bolt 17 is also maintained. The substantially constant angle of contact $\alpha$ as well as the continual engagement between the feed roll 9 and the bolt 17 during the turning motion of the winding star assures that air is excluded from the bolt as the winding continues during the turning process, and further assures that no formation of wrinkles or shifting of layers in the material being wound can occur.

Figure 4:
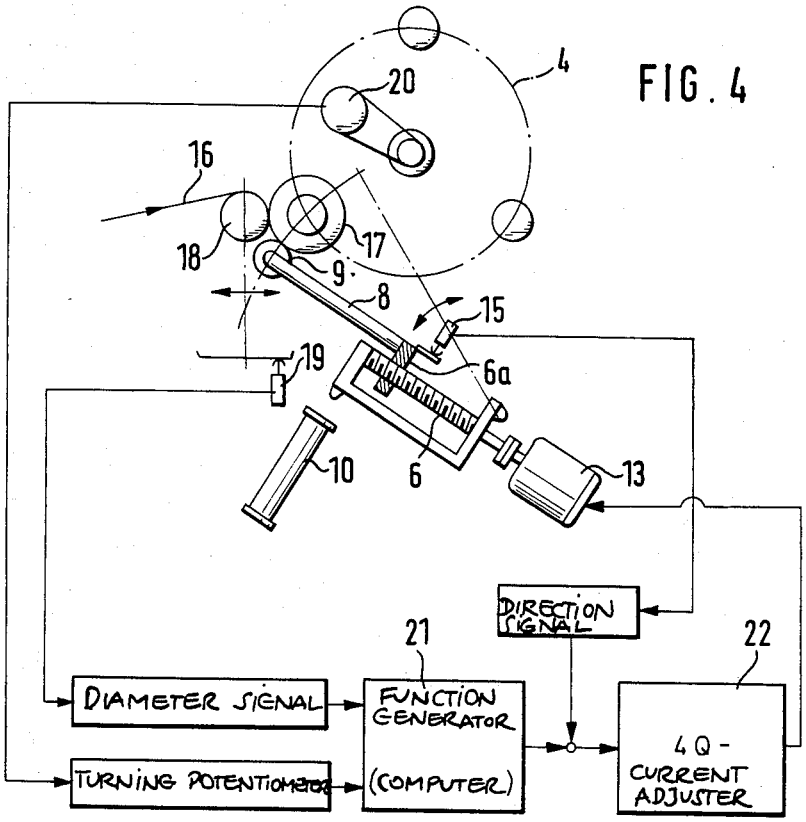
FIG. 4 is a schematic diagram similar to that shown in FIG. 1 illustrating in block diagrammatic form a control system for adjusting the position of the feed roll.

The substantially constant angle of contact between the web of material 16 and the feed roll 9 is achieved by an electronically controlled adjustment of the electric motor 13. The diameter of the bolt 17 is determined by a sensing device 19 (see FIG. 4) that measures the distance between bolt 17 and the roller 18. The tilt position of the winding star is determined by a further sensor, such as a rotatable potentiometer 20. Signals representative of the bolt diameter and of the tilt position of the winding star are fed to the function generator or computer 21 by suitable signal devices. Function generator or computer 21 determines the proper position of the feed roll 9, to maintain substantially constant the angle of contact $\alpha$, and feeds a signal to the position control device 22. Position control device 22 also receives information as to the actual position of the feed roll 9 from a position indicator 15 and, by comparing the actual position of the feed roller with the desired position signal generated by function generator or computer 21, produces an error signal which is used to control electric motor 13 in such manner that the feed roll 9 assumes the proper position to maintain substantially constant the angle of contact $\alpha$ during the turning motion of the winding star between the winding position 1 and the bolt removal position 2.

Figure 2:
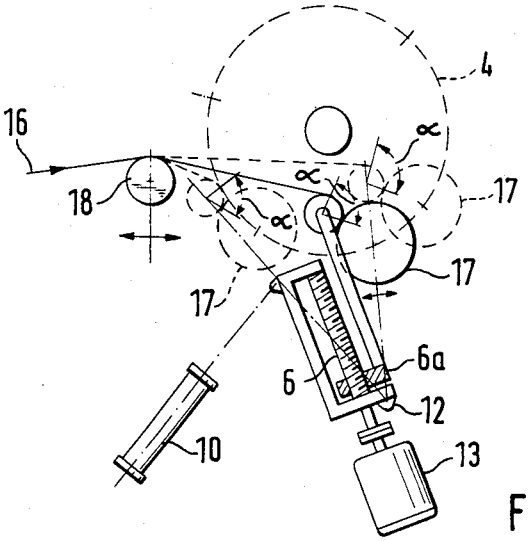
FIG. 2 shows the winding machine of the present invention with the feed roll system being shifted to various different positions.
Figure 3:
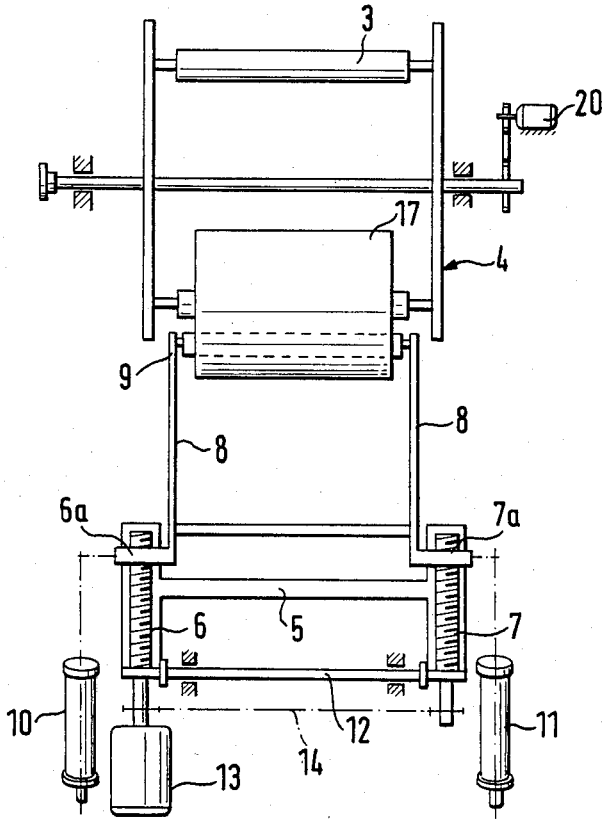
FIG. 3 is a front view of the winding machine shown in FIG. 1.

More particularly as will be seen by comparison of FIGS. 1 and 2, rotation of the motor 13 and consequent rotation of spindles 6, 7 causes the spindle nuts 6*a*, 7*a* to travel along the spindles 6, 7 in a direction transverse to the direction of pivot axis 12, thereby to successively adjust the position of the axis of rotation of feed roller 9 relative to pivot axis 12 as the bolt shifts in position from its winding position to its removal position.

As soon as the bolt 17 reaches the removal position 2, further rotational motion of the star 4 is stopped. An automatic exchange system (not shown) is provided to separate the full bolt 17 from the winding star and to place an empty bolt on the winding star at bolt position 3 which is now shifted to winding position 1, so that a new bolt can be wound at position 1. The cylinders 10, 11 pivot the frame 5 back into the starting position shown in FIG. 1, and the electric motor 13 returns the feed roll into the starting position also shown in FIG. 1. In this starting position, the feed roll 9 rests in the winding position against the new bolt, whereafter the same sequence of steps can take place.

While I have thus described a preferred embodiment of the present invention, it will be understood that the foregoing description is intended to be illustrative only and not limitative of the present invention. Various modifications will be suggested to those skilled in the art, and all such modifications as are in accord with the principles described are meant to fall within the scope of the appended claims.

Having thus described my invention I claim:

1. A multiple bolt turning machine comprising a winding star which is adapted to be rotated from one to the next of a plurality of bolt positions, at least one of said positions comprising a bolt winding position and at least one other of said positions comprising a bolt removal position, a feed roll adapted to engage a web of material being wound onto said bolt at said bolt winding position, first positioning means for shifting the position of said feed roll about a pivot axis spaced from and parallel to the axis of rotation of said feed roll as said winding star rotates to move a bolt from said winding position to said removal position thereby to maintain said feed roll in contact with the incoming web of material and in engagement with the exterior of said bolt during said movement of said bolt, and second positioning means operable concurrently with said first positioning means for adjusting the distance between said pivot axis and the axis of rotation of said feed roll to maintain the angle of contact between said feed roll and said web of material substantially constant throughout the movement of said bolt between said winding and removal positions, said feed roll being mounted in a frame which is mounted for pivotal motion about said pivot axis, said second positioning means comprising motor means mounted for movement with said frame as said frame is pivoted about said pivot axis.

2. The multiple bolt turning machine of claim 1 including means responsive to the diameter of said bolt for controlling the operation of said second positioning means.

3. The multiple bolt turning machine of claim 1 including first sensor means responsive to the diameter of said bolt for generating a first control signal, second sensor means responsive to the rotational position of said winding star for generating a second control signal, third means responsive to the existing position of said feed roll as it is moved by said first positioning means for generating a third control signal, and control means jointly responsive to said first, second and third control signals for controlling the operation of said second positioning means.

4. The multiple bolt turning machine of claim 1 wherein said motor means is a direct current electric motor.

5. The multiple bolt turning machine of claim 1 wherein said first positioning means comprises further motor means coupled to said frame for pivoting said frame and said first-mentioned motor means about said pivot axis.

6. The multiple bolt turning machine of claim 5 wherein said further motor means comprises at least one pneumatic piston-cylinder device.

7. The multiple bolt turning machine of claim 5 wherein said further motor means comprises at least one hydraulic piston-cylinder device.

8. The multiple bolt turning machine of claim 1 wherein said feed roll is mounted in said frame for movement toward and away from said pivot axis in a direction transverse to said pivot axis.

9. The multiple bolt turning machine of claim 8 wherein said motor means comprises an electric motor having a shaft which rotates a threaded spindle, a spindle nut in thread engagement with said spindle, the central axis of said feed roll being supported for rotation in bearing means, and means connecting said spindle nut to said bearing means whereby rotation of said motor shaft effects movement of said feed roll in said transverse direction relative to the said pivot axis of said frame.

* * * * *